US006181061B1

(12) United States Patent
Inoue

(10) Patent No.: US 6,181,061 B1
(45) Date of Patent: Jan. 30, 2001

(54) IMAGE DISPLAY DEVICE

(75) Inventor: Akira Inoue, Tokyo (JP)

(73) Assignee: Mitsubishi Denki Kabushiki Kaisha, Tokyo (JP)

( * ) Notice: Under 35 U.S.C. 154(b), the term of this patent shall be extended for 0 days.

(21) Appl. No.: 09/314,137

(22) Filed: May 19, 1999

(30) Foreign Application Priority Data

Jan. 12, 1999 (JP) ..... 11-004983

(51) Int. Cl.[7] ..... H01J 19/74; H01J 1/30
(52) U.S. Cl. ..... 313/495; 313/113
(58) Field of Search ..... 313/495–497, 313/113, 479, 326

(56) References Cited

U.S. PATENT DOCUMENTS 5,497,046 * 3/1996 Van Gorkom et al. ..... 313/495 X
5,910,705 * 6/1999 Cathey et al. ..... 313/495 X

FOREIGN PATENT DOCUMENTS 5-205668 8/1993 (JP) .

* cited by examiner

*Primary Examiner*—Ashok Patel

(57) ABSTRACT

An image display device has a front case provided with a phosphor screen on an inner surface thereof, a rear case fixed to the front case so that the front case and the rear case are hermetically sealed to form an airtight chamber therebetween, a cathode board including a cathode which is disposed within the airtight chamber and faces the phosphor screen, and a black surface treatment film disposed on at least one of a surface of the cathode board on a side of the rear case and an inner surface of the rear case.

5 Claims, 3 Drawing Sheets

IMAGE DISPLAY DEVICE

BACKGROUND OF THE INVENTION

The present invention relates to a flat image display device in which electrons emitted from a plurality of cathodes disposed on a cathode board impinge on a phosphor screen coated on an inner surface of a front glass case to display an image.

FIG. 4 is a cross-sectional view schematically showing a conventional flat image display device. As shown in FIG. 4, the conventional image display device comprises a front glass case 21 having a phosphor screen 22 on an inner surface thereof and a rear case 23. The front glass case 21 and the rear case 23 are hermetically sealed by frit glass at a sealing portion 25. Within an airtight chamber 24 are provided a cathode board 26 having cathodes facing the phosphor screen 22 for emitting electrons and a collector electrode 27 for collecting electrons emitted from the cathodes. As shown in FIG. 4, the electrode board 26 is supported by a plurality of support columns 28 fixed to the inner surface of the rear case 23 to face the phosphor screen 22.

FIG. 5 is an enlarged cross sectional view schematically showing a broken line part 30 of FIG. 4. In FIG. 5, a reference numeral 31 denotes a cathode (for instance, a conical cathode) for emitting electrons. A plurality of cathodes are orderly arranged in matrix form so that the cathodes correspond to the phosphor dots composing the phosphor surface 22. In FIG. 5, a reference numeral 32 denotes a cathode electrode for applying a voltage to the cathodes 41, a reference numeral 33 denotes an insulating layer, and a reference numeral 34 denotes a gate electrode. Although the cathodes 31 in FIG. 5 are field emission type, they may be replaced with thermionic emission type cathodes.

In the above-described image display device, the electrons are emitted from the desired cathodes 31 when a predetermined negative voltage is applied to the cathode electrode 32 and a predetermined positive voltage is applied to the gate electrode 34. The emitted electrons are converged by electrostatic lens effect of the penetrating hole 27*a* formed in the collector electrode 27, and impinge on a metal back layer (not shown) provided on the phosphor surface 22 and to which a high voltage (e.g., +10kV) is applied. As a result, the phosphor dots of the phosphor screen 32 emit light to form an image. At this time, a considerable amount of heat is generated due to the electron emission in case of the field emission type or current flowing wiring an resistance in case of thermionic emission type.

However, in the above-described conventional image display device, since a high vacuum is maintained in the picture tube, there is no heat dissipation such as convection. Therefore, considerable heat is accumulated in the cathode board 6 to make it high temperature. The thermal expansion of the cathode board 6 makes the problems that a relationship between the electron emission points in the cathode 31 and pixels of the phosphor surface 22 is changed. As a result, a positional relationship between the cathodes 41 of the cathode board 36 and the phosphor dots of the phosphor screen 32 is changed, so the electrons emitted from the cathode electrodes 41 cannot impinge on the adequate phosphor dots, making it impossible to form an image of high quality. Further, in case of too excessive thermal expansion of the cathode board 6, it may be broken.

SUMMARY OF THE INVENTION

It is an object of the present invention to provide an image display device having high thermal radiation from the cathode board.

According to the present invention, an image display device comprises a front case provided with a phosphor screen on an inner surface thereof; a rear case fixed to the front case so that the front case and the rear case are hermetically sealed to form an airtight chamber therebetween; a cathode board including a cathode which is disposed within the airtight chamber and faces the phosphor screen; and a black surface treatment film disposed on at least one of a surface of the cathode board on a side of the rear case and an inner surface of the rear case.

BRIEF DESCRIPTION OF THE DRAWINGS

The present invention will become more fully understood from the detailed description given hereinbelow and the accompanying drawings which are given by way of illustration only, and wherein.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment

Figure 1A:
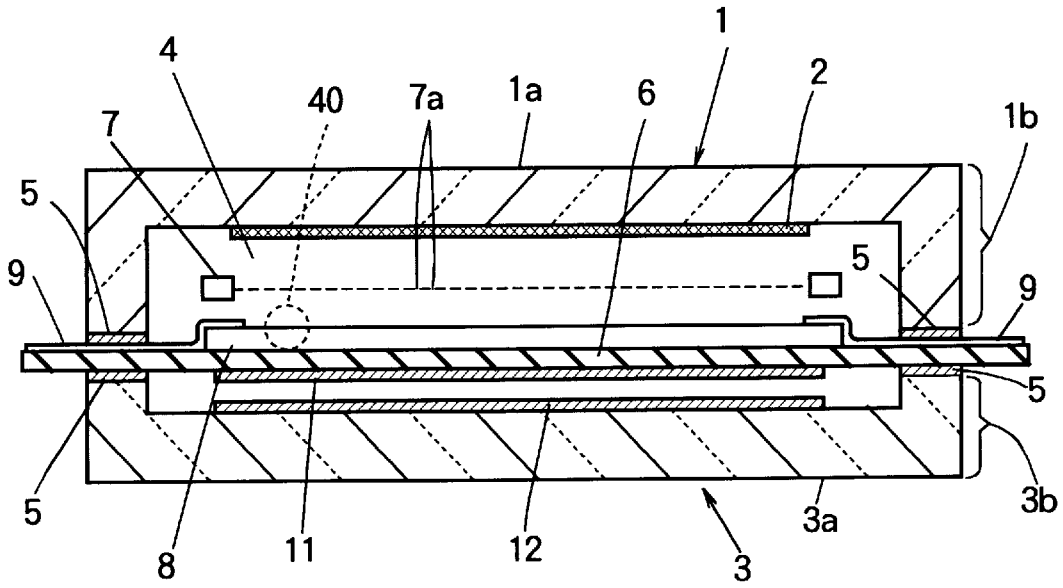
FIGS. 1A and 1B are a cross sectional view and a plan view showing an image display device according to a first embodiment of the present invention.
Figure 1B:
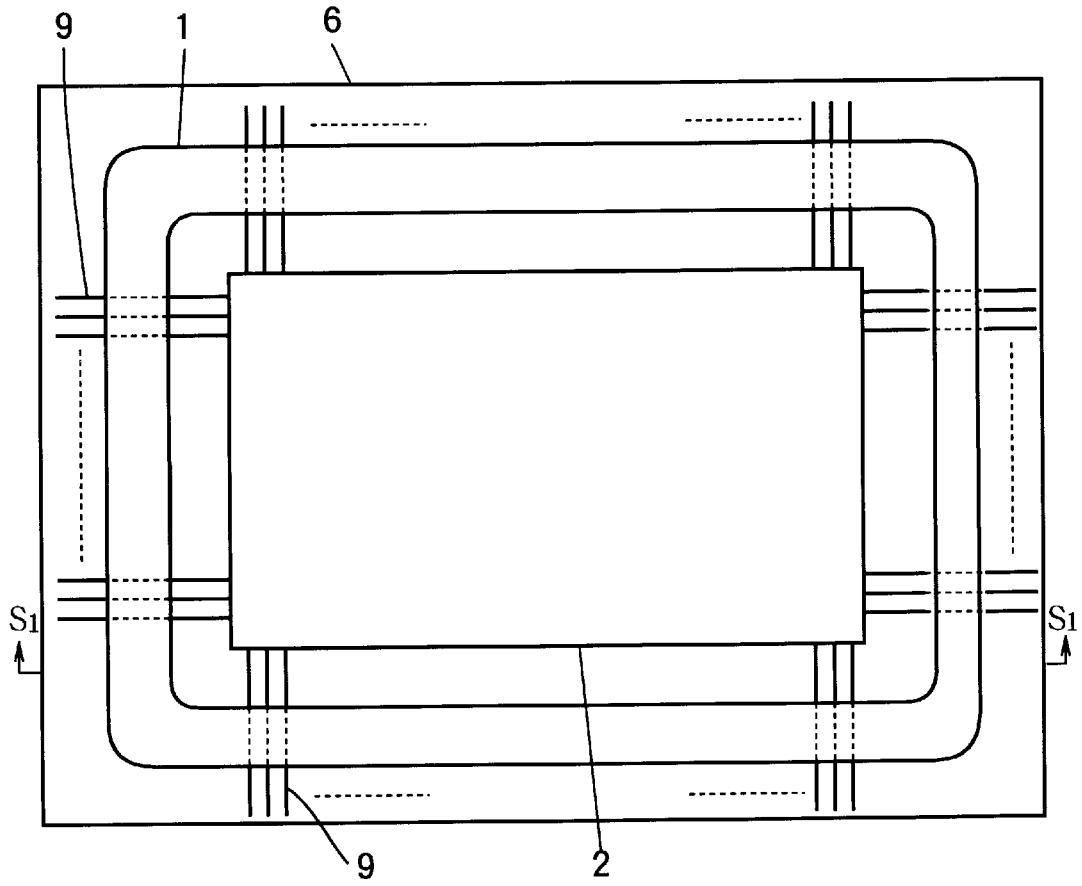

FIGS. 1A and 1B are a cross sectional view and a plan view schematically showing an image display device according to a first embodiment of the present invention. The cross section shown in FIG. 1A corresponds to the cross section taken along a line $S_1$—$S_1$ in FIG. 1B.

As shown in FIGS. 1A and 1B, the image display device of the first embodiment has a front glass case 1 provided with a phosphor screen 2 on an inner surface thereof, a rear case 3 facing the front glass case 1, and a sealing portion 5 with which the front glass case 1 and the rear case 3 are hermetically sealed so that an airtight chamber 4 is formed between the inner surface of the front glass case 1 and an inner surface of the rear case 3. The front glass case 1 includes a face portion 1*a* on which the phosphor screen 2 is provided and a side wall 1*b* extending from the face portion 1*a* toward the rear case 3. The rear case 3 includes a rear portion 3*a* and a side wall 3*b* extending from the rear portion 3*a* toward the front glass case 1. The sealing portion 5 is formed between the side wall 1*b* of the front glass case 1 and the side wall 3*b* of the rear case 3, for example, by frit glass.

Figure 5:
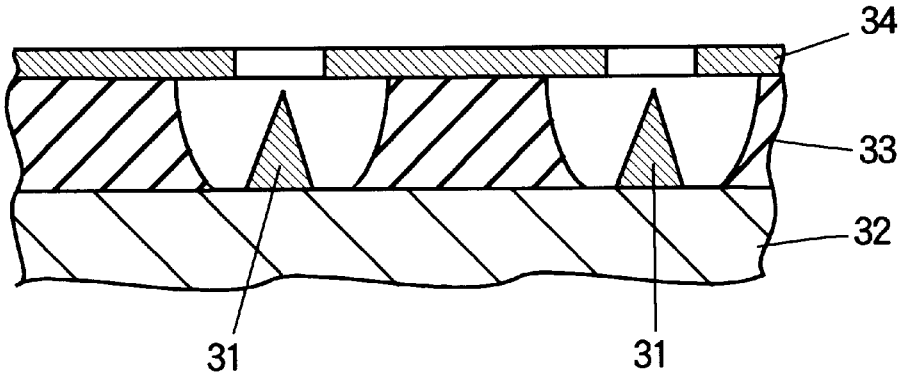
FIG.5 CONVENTIONAL ART
FIG. 5 is an enlarged cross sectional view of broken line parts of FIGS. 1A and 1B, FIG. 2, FIG. 3, and FIG. 4.

Further, the image display device of the first embodiment has a cathode board 6 facing the phosphor screen 2 within the airtight chamber 4 and a collector electrode 7 provided between the cathode board 6 and the phosphor screen 2. The collector electrode 7 has a function of collecting electrons emitted from the cathodes and is supported on the front glass case 1 or the cathode board 6, for instance. A cathode portion 8 of the cathode board 6 includes a plurality of cathodes 31 (show in FIG. 5) facing the phosphor screen 2 for emitting electrons and a wiring pattern 9 for applying a voltage to the cathodes 31. The cathode 31 is, for instance, conical as shown in FIG. 5, and electron emitting is controlled by the voltages applied to the cathode 31 and the gate electrode 34. A plurality of cathodes 31 are arranged in matrix form and correspond to the phosphor dots composing the phosphor screen 2. The phosphor dots of each color R, G or B are arranged in matrix of 480 rows and 640 columns, for instance.

The image display device of the first embodiment also has black treatment films 11 and 12 disposed on a surface of the cathode board 6 on a side of the rear case 3 and an inner surface of the rear case 3. The black treatment films 11 and 12 are formed before the assembly of the front glass case 1, the cathode board 6 and the rear case 3. One method to form the black treatment films 11 and 12 at low cost are spray method using graphite liquid. Alternately, the black treatment films 11 and 12 may be formed by deposition of aluminum. The deposition avoid the decontamination in the chamber 4.

In the above-described image display device of the first embodiment, electrons are emitted from the cathode 31 when a given negative voltage is applied to the cathode 31 and a given positive voltage is applied to the gate electrode 34. The emitted electrons are collected by electrostatic effect of the penetrating holes 7*a* of the collector electrode 7, and accelerated by high voltage (for instance, 10kV) applied to the metalback layer 2*a* provided on an inner surface of the phosphor screen 2 on the side of the cathode board 6. The accelerated electrons with high energy strikes the phosphor dots of the phosphor screen 2, causing the phosphor dots to emit light so that an image is displayed on the phosphor screen 2.

As described above, in the image display device of the first embodiment, the heat generated in the cathode board 6 is effectively emitted to the outside of the chamber 4 by radiation from the black treatment films 11 and 12. Therefore, it is possible to reduce color shift and color inconsistency resulted from thermal expansion of the cathode board 6, thereby making it possible to form an image of high quality. Further, the image display device of the first embodiment can prevent the cathode board 6 and the sealing portion 5 from being broken due to the thermal expansion of the cathode board 6.

Furthermore, the cathode board 6 is not supported on the rear portion 3*a* of the rear case 3 and is held on the sealing portion 5 between the side wall 1*b* of the front glass case 1 and the side wall 3*b* of the rear case 3, a deformation or inward warp of the rear portion 3*a* of the rear case 3 occurring after ejection of gas from the airtight chamber 4 does not cause a deformation or warp of the cathode board 6. As a result, a positional relationship between the cathodes 41 of the cathode board 6 and the phosphor dots of the phosphor screen 2 is not changed, so the electrons emitted from the cathodes 41 impinge on the adequate phosphor dots, making it possible to form an image of high quality.

Second Embodiment

Figure 2:
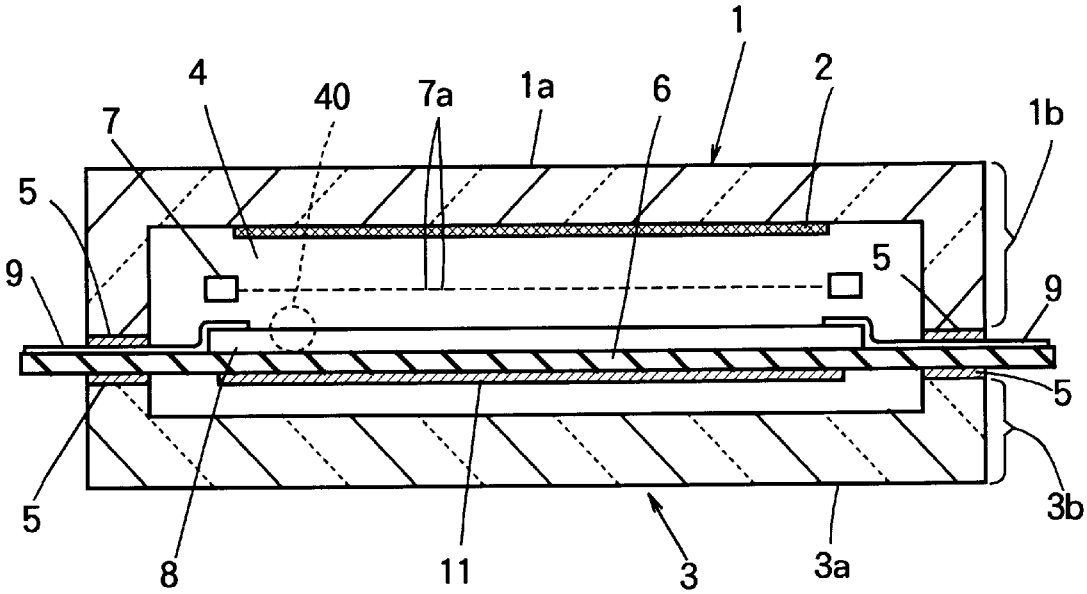
FIG. 2 is a cross sectional view showing an image display device according to a second embodiment of the present invention.

FIG. 2 is a cross sectional view schematically showing an image display device according to a second embodiment of the present invention. Those structures in FIG. 2 that are identical to or correspond to structures in FIG. 1A are assigned identical symbols. The image display device of the second embodiment is different from that of the first embodiment in that the black surface treatment film 11 is provided on only a rear surface of the cathode board 6. Except for the above points, the second embodiment is the same as the first embodiment.

Third Embodiment

Figure 3:
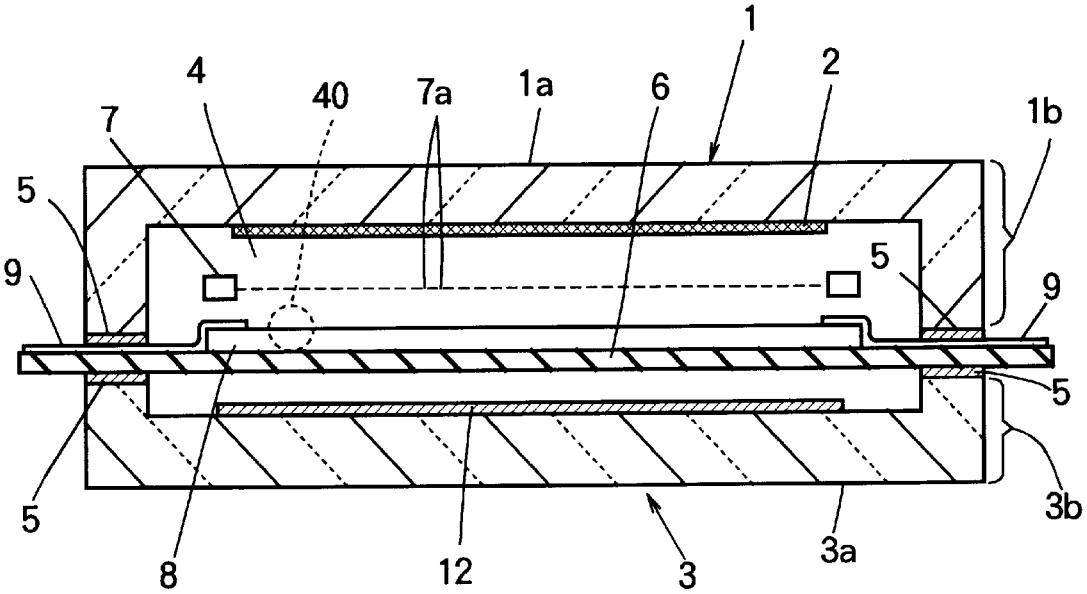
FIG. 3 is a cross sectional view showing an image display device according to a third embodiment of the present invention.
Figure 4:
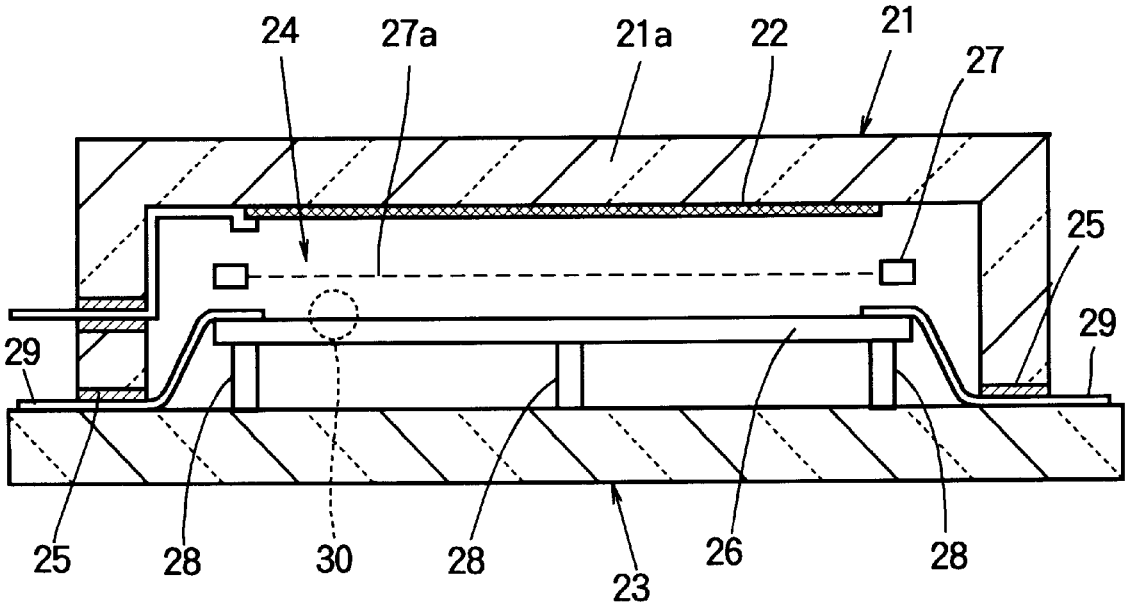
FIG.4 CONVENTIONAL ART
FIG. 4 is a cross sectional view showing a conventional image display device.

FIG. 3 is a cross sectional view schematically showing an image display device according to a third embodiment of the present invention. Those structures in FIG. 3 that are identical to or correspond to structures in FIG. 1A are assigned identical symbols. The image display device of the third embodiment is different from that of the first embodiment in that the black surface treatment film 12 is provided on only an inner surface of the rear case 3. Except for the above points, the third embodiment is the same as the first embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of following claims.

What is claimed is:

1. An image display device comprising:

a front case provided with a phosphor screen on an inner surface thereof;

a rear case fixed to said front case so that said front case and said rear case are hermetically sealed to form an airtight chamber therebetween;

a cathode board including a cathode which is disposed within the airtight chamber and faces the phosphor screen; and a black surface treatment film disposed on at least one of a surface of said cathode board on a side of said rear case and an inner surface of said rear case.

2. The image display device of claim 1, wherein said cathode board is held between said front case and said rear case by a sealing portion so that said cathode board is not in contact with an inner surf ace of said front case and the inner surface of said rear case.

3. The image display device of claim 1, wherein:

said front case includes a face portion on which the phosphor screen is provided and a side wall extending from said face portion toward said rear case;

said rear case includes a rear portion and a side wall extending from said rear portion toward said front case; and said sealing portion is formed between said side wall of said front case and said side wall of said rear case.

4. The image display device of claim 1, wherein said black surface treatment film is a graphite coating.

5. The image display device of claim 1, wherein said black surface treatment film is an aluminum deposited film.

* * * * *